US007267461B2

(12) United States Patent
Kan et al.

(10) Patent No.: US 7,267,461 B2
(45) Date of Patent: Sep. 11, 2007

(54) DIRECTLY VIEWABLE LUMINAIRE

(75) Inventors: Peter Kan, North Vancouver (CA); Adrian Weston, Burnaby (CA)

(73) Assignee: TIR Systems, Ltd. (CA)

( * ) Notice: Subject to any disclaimer, the term of this patent is extended or adjusted under 35 U.S.C. 154(b) by 236 days.

(21) Appl. No.: 11/046,176

(22) Filed: Jan. 28, 2005

(65) Prior Publication Data

US 2005/0207166 A1 Sep. 22, 2005

(30) Foreign Application Priority Data

Jan. 28, 2004 (CA) ..... 2,456,385
Mar. 30, 2004 (CA) ..... 2,462,767

(51) Int. Cl.
*F21S 8/04* (2006.01)

(52) U.S. Cl. ..... 362/373; 362/355; 362/311; 362/223; 362/147

(58) Field of Classification Search ..... 362/355, 362/311, 223, 147, 148, 145, 373; 359/599
See application file for complete search history.

(56) References Cited

U.S. PATENT DOCUMENTS 3,675,006 A * 7/1972 Zagel et al. ..... 362/223
4,384,316 A 5/1983 de Vos et al.
4,428,673 A * 1/1984 Yoshida ..... 359/599
4,514,792 A * 4/1985 Klaus ..... 362/294
4,729,076 A 3/1988 Masami et al.
5,173,839 A 12/1992 Metz, Jr.
5,390,094 A * 2/1995 Evanisko ..... 362/267
5,440,471 A * 8/1995 Zadeh ..... 362/365
5,782,555 A 7/1998 Hochstein
5,803,592 A 9/1998 Lawson
5,857,767 A 1/1999 Hochstein
6,211,626 B1 4/2001 Lys et al.
6,280,052 B1 8/2001 White
6,394,628 B1 5/2002 Wang
6,498,355 B1 12/2002 Harrah et al.
6,561,690 B2 5/2003 Balestriero et al.
6,709,143 B2 * 3/2004 Harada et al. ..... 362/558

FOREIGN PATENT DOCUMENTS

EP 0882929 A1 12/1998
JP 05174791 A * 7/1993

OTHER PUBLICATIONS

International Search Report, Application No. PCT/CA2005/000110, Jun. 28, 2005.

* cited by examiner

*Primary Examiner*—Sharon Payne
(74) *Attorney, Agent, or Firm*—Dorsey & Whitney LLP

(57) ABSTRACT

A luminaire comprising a housing having thermally separate compartments for an electronics portion and a lighting portion. These thermally separate compartments can provide thermal isolation between the electronics portion and the lighting portion. The lighting portion comprises a plurality of light-emitting elements and further includes an optical device comprising two linear diffuser elements and can be used to further improve the light emission characteristics of the light-emitting elements thereby providing a directly viewable luminaire wherein the illumination produced by point light sources appears uniform along the length of the luminaire. A power supply for supply of energy to the light-emitting elements and a controller for controlling application of energy from a power source to the light-emitting elements is provided in the electronics portion and can be thermally separated within the electronics portion.

10 Claims, 12 Drawing Sheets

DIRECTLY VIEWABLE LUMINAIRE

CROSS-REFERENCE TO RELATED APPLICATIONS

This application claims priority to Canadian Patent Application No. 2,456,385, filed Jan. 28, 2004 and claims priority to Canadian Patent Application No. 2,462,767, filed Mar. 30, 2004; both of which are hereby incorporated herein by reference.

FIELD OF THE INVENTION

The present invention pertains to lighting and in particular to a directly viewable luminaire.

BACKGROUND OF THE INVENTION

Due to their higher overall luminous efficacy and flexibility for achieving various light patterns, luminaires using high-flux LEDs are fast emerging as the preferred lighting architecture over conventional light fixtures. These luminaires are increasingly used in a wide range of applications where high light output is required, such as theatrical spotlights, high-power flashlights, and automotive headlights. They are also penetrating mainstream commercial applications like task lights, accent lights, wall washing, signage, advertising, decorative and display lighting, cove lighting, wall sconces, facade lighting, and custom lighting.

The ability to maximize light output from a luminaire increases energy efficiency and reduces production and maintenance costs. Typically, a high flux LED luminaire comprises a plurality of high flux light-emitting diodes, as well as a power supply unit for excitation of the light-emitting diodes. Through maximizing the light output in the desired light pattern, power consumption for these light-emitting diodes may be reduced. Otherwise, additional power would be needed to overcome these light losses.

A primary concern in the design and operation of high flux LED luminaires is thermal management. The luminous intensity of a light module is quite often a strong function of its operational temperature. High flux LED luminaires tend to generate large amounts of heat during operation. Not only does this heat reduce the light output of a light-emitting diode, but it can also reduce the reliability and the life expectancy of the lighting module, due to premature failure of one or more light-emitting diodes. Accordingly, heat dissipation often becomes a critical design consideration as the undesirable heat negatively affects the performance of the luminaire.

Various heat dispersive systems such as heat sinks, use of metal-core printed circuit boards, heat absorbers or a combination thereof have been proposed. However, the existing heat dissipation systems generally spread the heat from a hot spot to another location for dissipation without coolth collection.

For example, U.S. Pat. No. 6,211,626 to Lys et al. discloses a heat dissipating housing made of a heat-conductive material for containing a lighting assembly therein. The heat dissipating housing contains two stacked circuit boards holding respectively a power module and a light module. The light module comprises a light emitting diode (LED) system mounted on a heat spreader plate that is in contact with the housing for dispersing away the heat generated by the LED system that is in thermal contact with the plate, thereby conducting heat towards the housing.

A particular advantage of the Lys et al. heat spreader is that when the heat source is located proximate to the center of a circular plate, the temperature at the boundary thereof is substantially constant. Accordingly, the heat spreader distributes the heat evenly to a thermally connected housing which ejects the heat into the surrounding environment. However, this heat dissipation system may not work well with housings which exhibit hot spots when dissipating heat.

U.S. Pat. No. 4,729,076 to Masami et al. teaches a heat dissipation mechanism for an LED traffic signal. A heat absorber such as a heat conductive resin in thermal communication with a printed circuit board on the other side of which an array of LEDs is formed, is disclosed. A finned heat sink is in thermal contact with the heat absorber. The heat absorber collects the heat generated by the array of LEDs and provides a conductive path for the heat towards the heat sink for dissipation into the ambient environment. The disclosed heat absorber, however, is typically a poor heat conductor and does not provide for optimal heat transfer to the heat sink.

U.S. Pat. No. 5,173,839 to Metz, Jr. is directed to an LED array thermally bonded to a strip of alumina that is bonded to a heat sink bonded via thermally-conductive tape. Similarly, U.S. Pat. No. 5,857,767 to Hochstein teaches mounting LEDs on a metal core PCB having an integral heat sink with electrically and thermally conductive epoxy.

The optical performance of a light-emitting diode is another important consideration when designing high flux LED luminaires. The light-emitting diode used to generate light often has special emission characteristics. Optical devices such as reflectors or lenses have specific geometries which enable them to ameliorate the performance of the light-emitting diode. The performance of the LED can be improved by a judicious choice of optical devices adapted to particular output characteristics of the light-emitting diode.

Traditional directly viewed luminaires use light-emitting diodes with no optics and a housing comprising a transparent shield typically made of glass or plastic to protect the light-emitting diodes against natural elements. The transparent shield effectively blocks the light-emitting diode's output and reduces the overall illumination luminous flux output of the luminaire. Moreover, the individual light-emitting diodes are often visible through the transparent shield and could appear as point sources. This can further reduce light output uniformity and can cause a "pearl necklace" effect, which is undesirable.

A number of solutions have been proposed to alleviate the undesirable pearl necklace effect. One solution seeks to improve light output uniformity by providing a diffuse transparent shield surrounding the light-emitting diodes. However, in order to achieve good levels of luminous uniformity, the light-emitting diodes must be spaced relatively close with respect to one another. Due to design limitations, this solution is often not available, especially when using high flux light-emitting diodes whereby the close proximity of the light-emitting diodes creates a high concentration of unwanted heat. This problem is further exacerbated in luminaires having a plurality of light-emitting diodes of different colour combinations for colour mixing, where the distal spacing between the various light-emitting diodes must be minimized to generate a desired resultant colour.

Therefore there is a need for a new design for a directly viewable luminaire that can address these thermal and optical deficiencies identified in the prior art.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a directly viewable luminaire. In accordance with one aspect of the present invention there is provided a luminaire comprising a housing defining a first internal compartment containing one or more light-emitting elements mounted on a base connected to the housing, the housing further defining a second internal compartment containing electronic driver means coupled to the one or more light-emitting element for providing controlled electrical energy to the one or more light-emitting elements, said first compartment is thermally separated from the second compartment.

In accordance with another aspect of the present invention there is provided luminaire comprising: a housing defining a first internal compartment containing one or more light-emitting elements mounted on a planar support connected to the housing, the housing further defining a second internal compartment containing electronic driver means coupled to the one or more light-emitting elements for providing controlled electrical energy to the one or more light-emitting elements, the first and second internal compartments being thermally isolated from one another; and an optical means coupled to the housing for manipulating light emitted by the one or more light-emitting elements, said optical means comprising first and second diffuser elements positioned coaxially in a spaced apart configuration.

In accordance with another aspect of the present invention there is provided an optical device for use with a luminaire including two or more light-emitting elements, the optical device comprising: a first diffuser element configured to be positioned proximate to the two or more light-emitting elements, said first diffuser for diffusing emitted flux from the light-emitting elements; and a second diffuser element having a length and positioned in coaxial spaced apart alignment with the first diffuser, said second diffuser for providing secondary diffusion of the emitted flux; thereby enabling creation of a substantially constant luminance along the length of the second diffuser.

DETAILED DESCRIPTION OF THE INVENTION

Definitions

Figure 1:
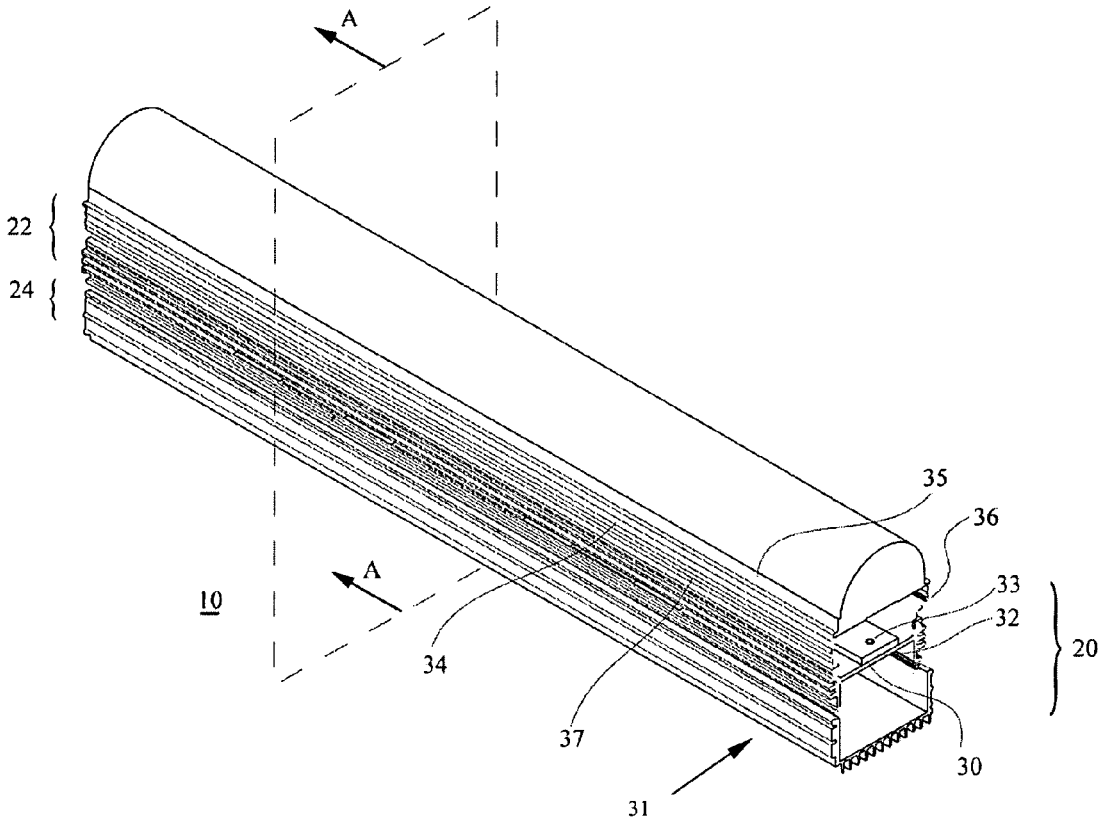
FIG. 1 shows an isometric view of a luminaire according to one embodiment of the present invention.

The term "light-emitting element" is used to define any device that emits radiation in the visible region of the electromagnetic spectrum when a potential difference is applied across it or a current is passed through it, for example, a semiconductor or organic light-emitting diode (LED or OLED, respectively) or other similar devices as would be readily understood. It would be obvious to one skilled in the art that elements that emit other forms of radiation such as infrared or ultraviolet radiation may also be used if desired in the present invention in place of or in combination with light-emitting elements.

Unless defined otherwise, all technical and scientific terms used herein have the same meaning as commonly understood by one of ordinary skill in the art to which this invention belongs.

The present invention arises from the realization that improved light output can be achieved by heat dissipation and improved light reflection. Accordingly, the degradation of flux as a function of increasing temperature in luminaires can be avoided by compartmentalizing and thermally isolating the heat generating elements such as the driver, power supply and the light-emitting elements into two or more thermally separate compartments within the luminaire. The compartmentalized components comprise thermally conductive material in contact with the luminaire housing which incorporates a finned or undulating surface to improve coolth collection. Moreover, an optical device comprising two linear diffuser elements that can be used to further improve the light emission characteristics of the light-emitting elements thereby providing a directly viewable luminaire wherein the illumination produced by point light sources appears uniform along the length of the luminaire.

By heat sinking the light-emitting elements to a material with high thermal conductivity such as aluminum, the operating temperature of the light-emitting elements can be reduced and the light output can be improved. Similarly, the heat generating components of the power supply unit and controller subsystems can also be heat sinked to a material of high thermal conductivity (such as aluminum, copper, silver, a thermally conductive polymer or the like) in order to dissipate the heat that they generate.

The present invention provides a luminaire comprising a housing having thermally separate compartments for an electronics portion and a lighting portion. These thermally separate compartments can provide a means for providing thermal isolation between the respective components, namely the electronics portion and the lighting portion. In this manner thermal interaction between these portions can be reduced, thereby improving performance of the luminaire. The lighting portion comprises a plurality of light-emitting elements and further includes optics for the manipulation of illumination created by the light-emitting elements. A power supply for supply of energy to the light-emitting elements and a controller for controlling application of energy from a power source to the light-emitting elements is provided in the electronics portion and these components can be thermally separated within the electronics portion.

Reference is now made to FIG. 1, which illustrates a luminaire pursuant to one embodiment of the present invention. The luminaire 10 includes a generally elongated housing 20 with separate upper and lower compartments 22, 24 respectively. The lower compartment 24 includes the power and control modules (not shown). The upper compartment 22 contains a plurality of light-emitting elements 33 mounted on a printed circuit board (PCB) or metal-core printed circuit board (MCPCB) 32 which is mounted on an H-shaped supporting base 30. The supporting base 30 includes upwardly projecting elements 35, 36 which form the walls of the upper compartment 22, and downwardly projecting elements 37, 38 which form a portion of the lower compartment 24.

It will be appreciated by one skilled in the art that the boards 32 can be attached or held to the base 30 in a number of ways known to those skilled in the art including, but not limited to gluing, screwing or bolting, for example. Further, it will be appreciated by one skilled in the art that the board 32 and the light-emitting elements 33 can be electrically connected in a number of ways including, but not limited to, electrically connecting wires from a power supply unit and a controller (not shown) to wire leads located on the board 33 which includes circuit traces to the individual light-emitting elements. To further take advantage of the luminaire housing's 20 unique heat dissipation properties, the thermal connection between the board 32 and the base 30 can be enhanced through the use of a heat conductive adhesive tape or thermal grease, for example. A heat conductive adhesive tape or thermal grease has heat conduction properties that can enhance heat transfer and can enable one to increase the contact surface area between the board 32 and the base 30.

The supporting base 30 is advantageously constructed from a heat-conducting material, for example aluminum, and comprises a finned or undulating surface 34 to dissipate the thermal radiation from the light-emitting elements 33 generated during their operation. This heat can degrade the luminous performance of the light-emitting elements 33 and can reduce the life expectancy thereof. Accordingly, if an optimum performance of the light-emitting elements in terms of their luminous flux is to be achieved, thermal management of the light-emitting elements 33 is required to remove the excess heat away therefrom. The supporting base 30 can effectively act as a heat sink (or source of coolth) to conduct the heat away from the light-emitting elements 33 to the exterior, and the finned or undulating surface 34 can enhance the efficiency of this radiator effect.

Figure 2:
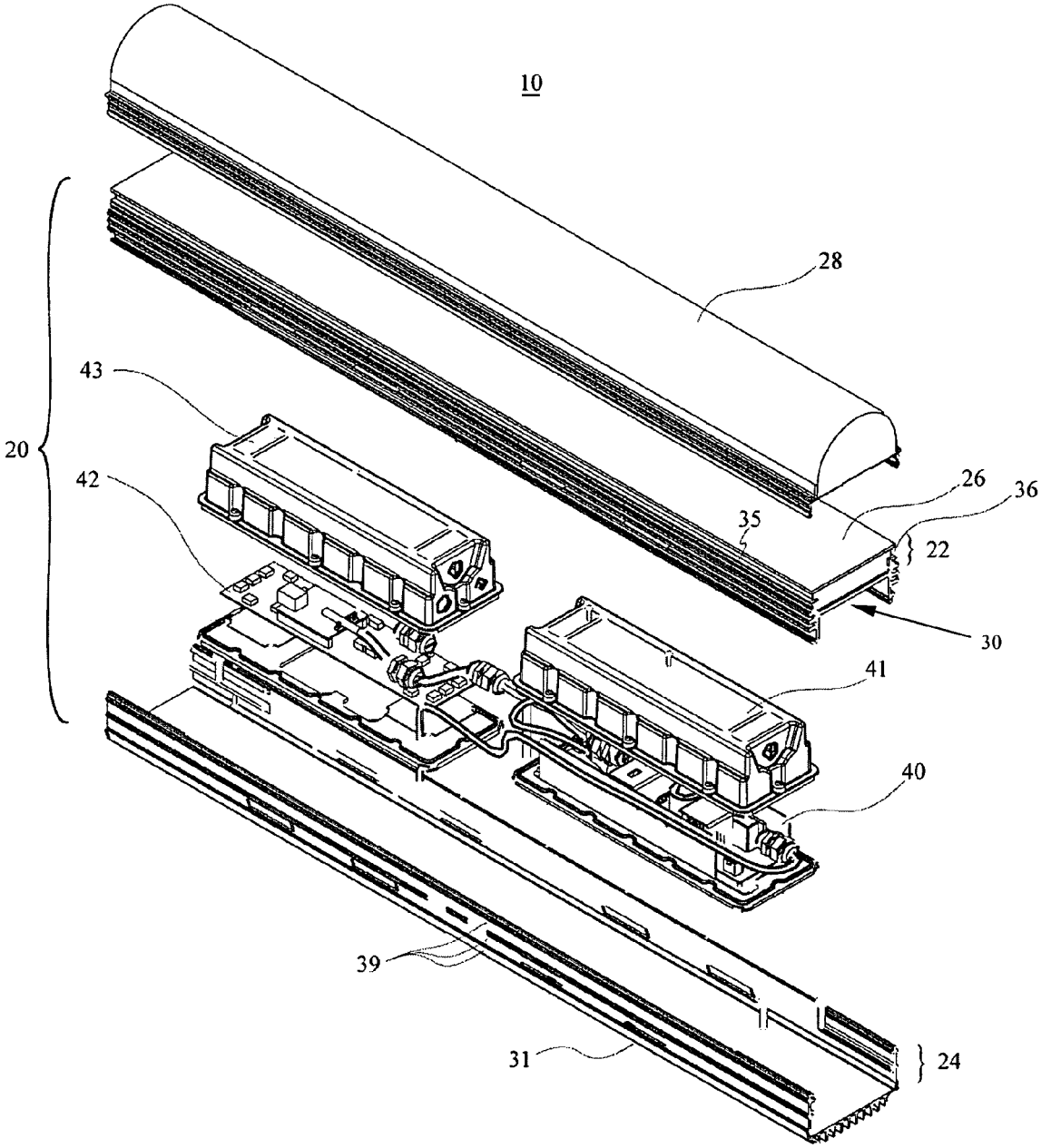
FIG. 2 illustrates an isometric exploded view of the embodiment of FIG. 1.

FIG. 2 illustrates an exploded view of the luminaire 10 of FIG. 1. The upper compartment 22 of the integrated luminaire housing 20 further includes a transmissive cover plate 26 which can be a translucent planar diffuser that can be bonded to the upwardly projecting elements 35, 36 using a sealant adhesive such as silicone to form a waterproof module. This sealed light portion forms the upper compartment 22 of the integrated luminaire housing 20. Advantageously, the lighting portion can comprise an elastomeric seal that allows for differential thermal expansion between the transmissive cover plate and the base formed from another type of material. This type of configuration can enable the use of the luminaire according to the present invention in regions having thermal gradients, for example.

Figure 3:
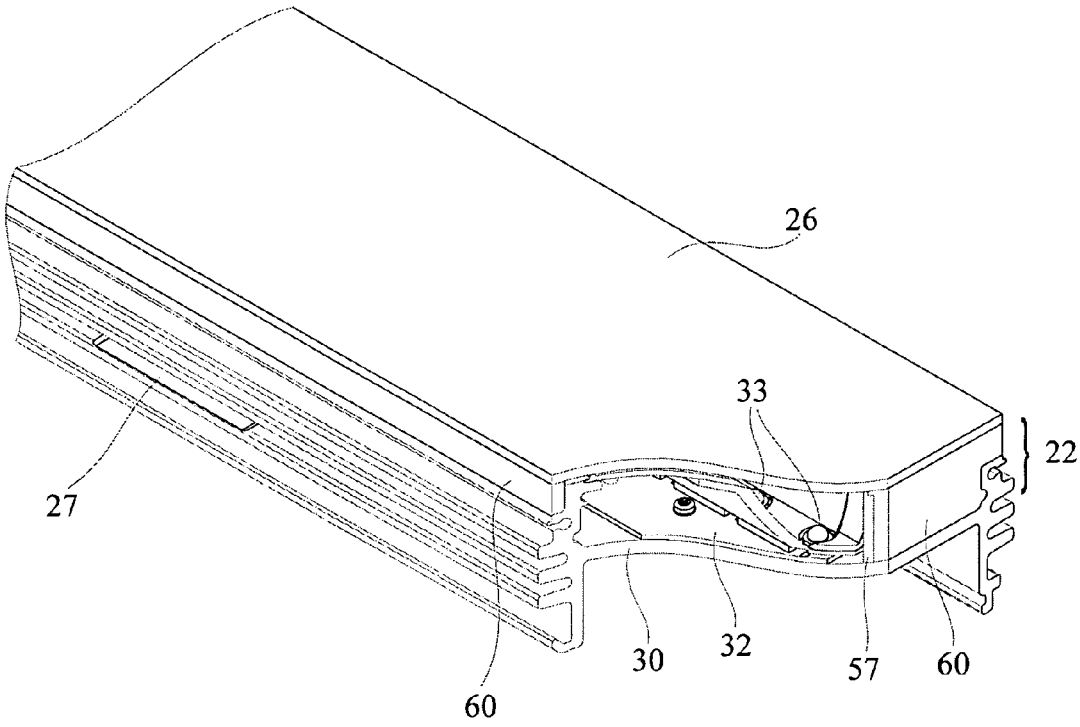
FIG. 3 shows a cut-away isometric view of the upper compartment of the luminaire of the embodiment of FIG. 1.

FIG. 3 illustrates a cut-away perspective view of the upper compartment 22 formed as a sealed light portion according to the embodiment of FIG. 1. A barrier or end cap 57 can be positioned at each end of the light portion in order to provide a means to seal the upper compartment 22. The barrier may be covered with a sealant 60 for example silicone or other suitable sealant, to hermetically seal the upper compartment 22, for example. Furthermore, as shown in FIG. 3, the heat sinking base 30 can further include a plurality of air vents 27 for improved ventilation and heat dissipation within the lower compartment.

Figure 4:
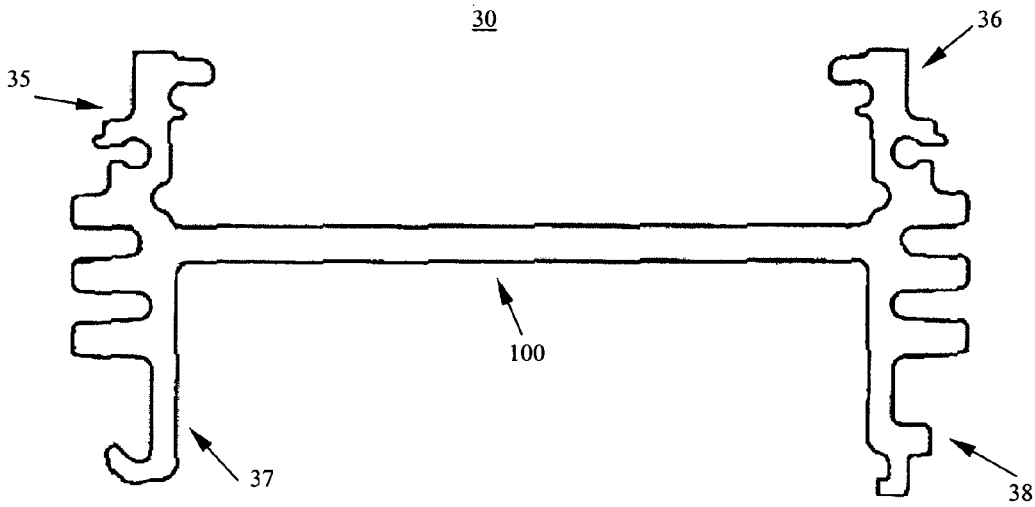
FIG. 4 is a cross sectional view of the H-shaped supporting base according to the embodiment of FIG. 1.
Figure 5:
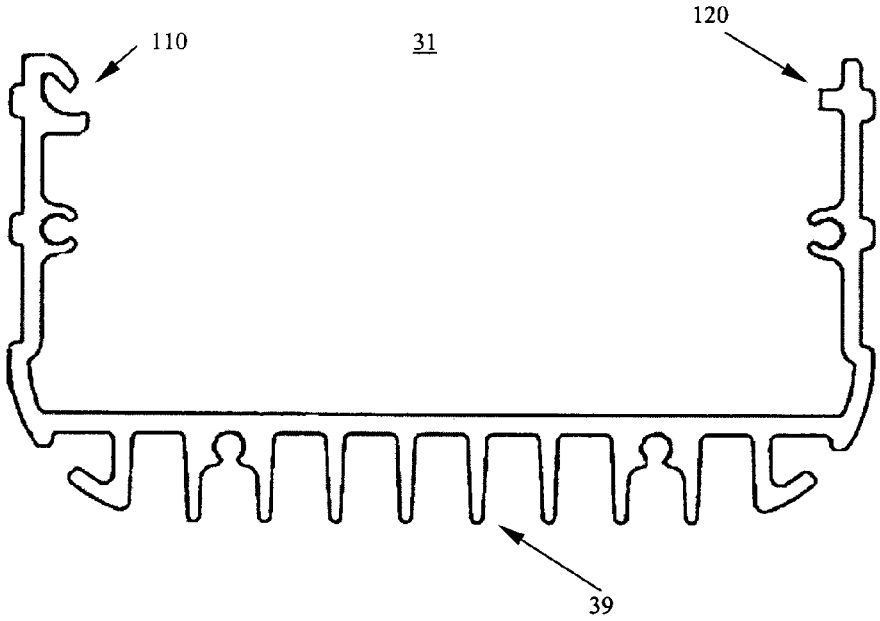
FIG. 5 is a cross sectional view of the U-shaped base cover of the embodiment according to FIG. 1.
Figure 8:
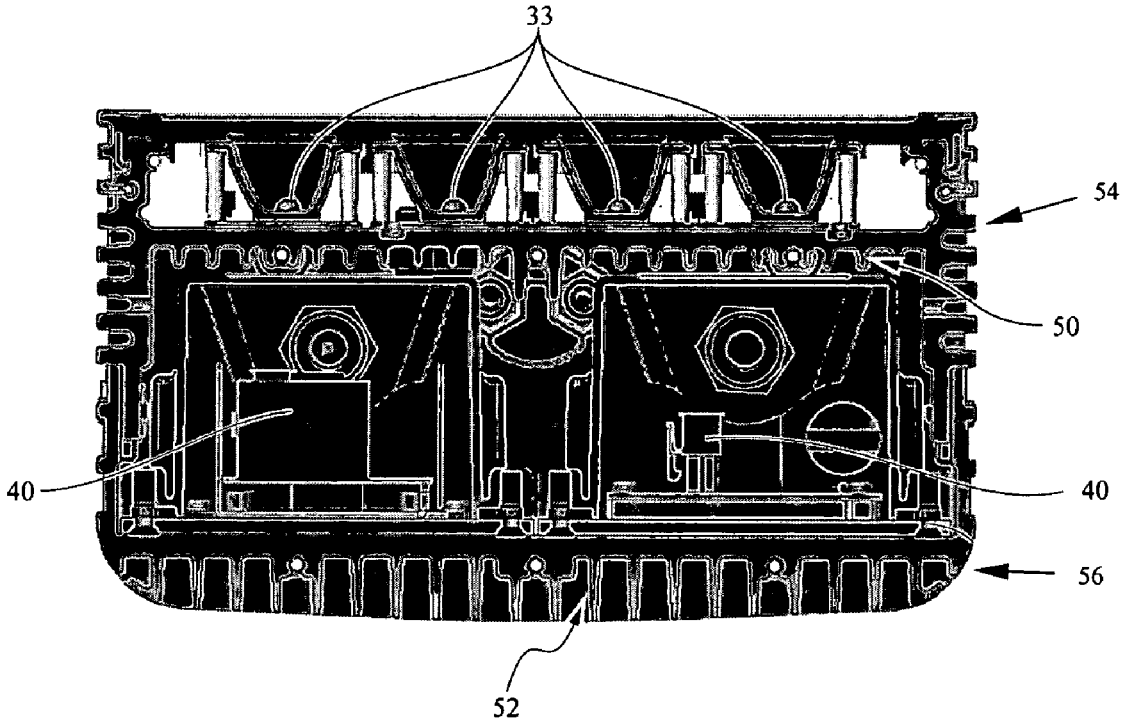
FIG. 8 illustrates a cross sectional view of the luminaire illustrated in FIG. 7 taken along the line B-B.

The lower compartment 24 of the integrated luminaire housing 20 of FIG. 2 comprises a power supply unit (PSU) 40 and a controller 42 such as a microcontroller in electrical communication with the light-emitting elements 33 to supply electrical power and control the luminous intensity of the light-emitting elements 33. Each of the PSU 40 and the controller 42 are surrounded by a U-shaped base cover 31 made of a highly thermally conductive material such as aluminum or the like to expel the heat generated by the PSU 40 and the controller 42 into the ambient environment. The base cover 31 may be coupled to the base 30 using interlocking elements that are integrated within the base and the base cover. For example as illustrated in FIGS. 4 and 5, downwardly projecting elements 37 and 38 can be specifically designed to mate with elements 110 and 120, respectively provided on the base cover. In order to secure this mating connection to longitudinal slip, a securing connection between the base and the base cover may be provided in the form of one or more screws or the like, for example. This form of interconnection between the base and the base cover may provide access to the PSU 40 and the controller 42 units without the need for completely dismantling the luminaire. As illustrated in FIG. 2, the base cover 31 also includes a finned or undulating outer surface 39 to improve the cooling effect of the base cover 31. In one embodiment, the underside 100 of the base 30 may further comprise fins or undulations in order to further enhance heat dissipation of the base 30. In one embodiment, the protrusions 110 and 120 of the base cover 31 and/or the downwardly projecting elements 37 and 38 of the base 30 comprise openings enabling the entry of air into the lower compartment for enhancing the thermal dissipation provided by the fins or undulations on the underside 100 of the base. This feature is illustrated in FIG. 8 which illustrates one embodiment of the present invention, wherein the base 54 comprises fins or undulations 50, to dissipate heat generated by the light-emitting elements thermally connected thereto, while the base cover 56 also comprises fins or undulations 52 for the provision of heat dissipation for the power supply and controller unit, for example.

The electronic subsystems PSU 40 and controller 42 may include associated heat sinks (not shown) and are preferably arranged in the integrated luminaire housing 20 so that as much surface area of their associated heat sinks as possible is exposed to the "cooler" external ambient environment to assist heat flow out of the luminaire. In the presently described embodiment of the invention, a power supply enclosure 41 manufactured from a material having low thermal conductivity, such as plastic is attached to the supporting base 30 in order to provide further thermal shielding for the various components of the luminaire 10 from the heat generated by the PSU 40. Similarly, a controller enclosure 43 covers the controller 42 and thermally isolates the components of the luminaire 10 from undesirable heat generated by the controller 42 during operation. The addition of the enclosures 41 and 43 can channel the heat from the PSU 40 and controller 42 through the more thermally conductive heat sink associated with the base cover 31 to the ambient environment outside. It is also observed that the enclosures 41 and 43 can further protect the PSU 40 and the controller 42 from exposure to natural elements such as rain or humidity as these covers can be sealingly connected to the base cover, for example through the use of a gasket or other sealing means, for example a sealant.

Advantageously, the thermal separation between the compartments 22, 24 may be further enabled by providing an additional thermal barrier (not shown) between these compartments 22, 24. In addition a heat shielding metallic or plastic barrier can provide a thermal barrier between the PSU 40 and the controller 42 systems. In one embodiment the sealed light portion and the sealed PSU 40 and controller 42 portions are then assembled together so that their heat sinks form the base cover 31 of the luminaire 10 allowing heat from within the luminaire 10 to flow to the cooler ambient air outside the luminaire 10.

Based on the foregoing, it is therefore appreciated that the luminaire housing of the present invention effectively provides for the operation of the light-emitting elements at a different temperature from the operation temperature of the PSU and the controller. This thermal separation is provided by the inclusion of separate compartments for the light portion and the electronics portion or power management unit to limit the thermal impact of one subsystem on another. The compartmentalization of the housing into an upper compartment and a lower compartment may enable operation of the light-emitting elements at a higher temperature while operating the power management unit at a lower temperature, for example due to the thermal separation thereof. Accordingly, through thermal separation, each subsystem can perform at a desired level while limiting thermal impact of one subsystem on another within the luminaire.

Figure 6:
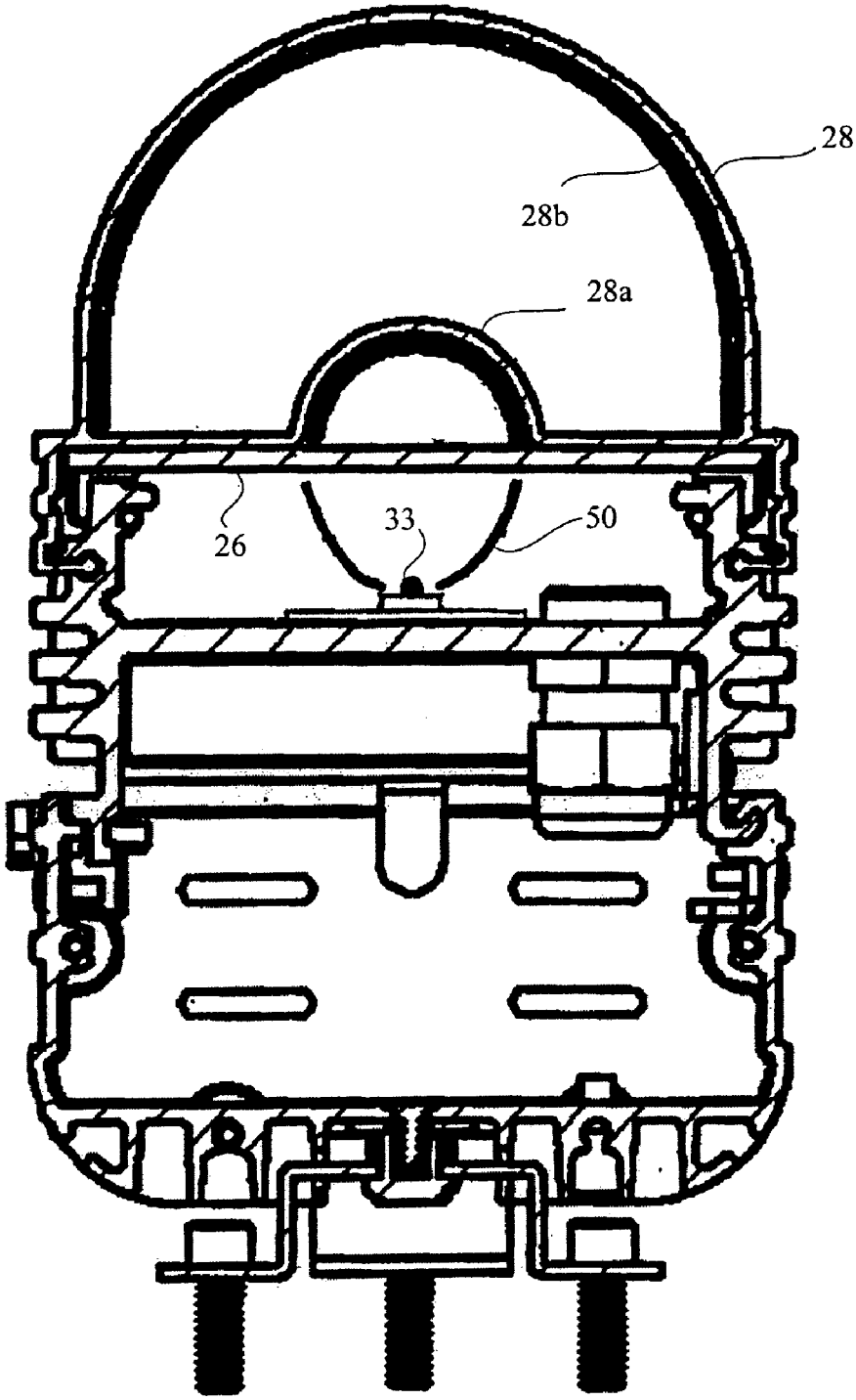
FIG. 6 shows a side cross-sectional view of the luminaire of FIG. 1 taken along the line A-A.
Figure 10A:
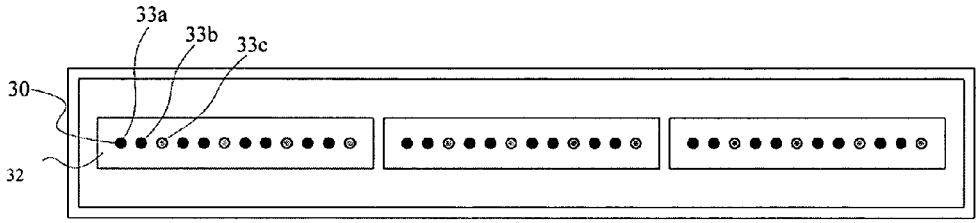
FIG. 10A illustrates a combination of blue, green and red light-emitting elements arranged in a linear fashion according to one embodiment of the present invention.
Figure 10B:
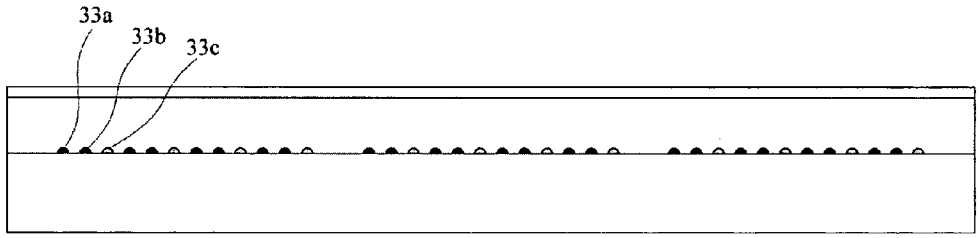
FIG. 10B shows the side view of FIG. 10A.

Reference is now made to FIG. 6, which shows a side cross-sectional view of the luminaire 10 along line A-A of FIG. 1. The luminaire 10 shown in FIG. 6 includes a linear array of light-emitting elements disposed on a PCB thermally connected to the H-shaped base 30 at the approximate focus of a linear compound parabolic collector 50. The light-emitting element array can be red, green and blue light-emitting elements or other colours as would be readily understood. Using a combination of red, green and blue light-emitting elements 33*a*, 33*b* and 33*c* (shown in FIG. 10A and in elevation in FIG. 10B) mounted in a linear array, it is possible to achieve any desired colour by mixing the three colours using an optical structure comprising various diffusing elements. These diffusing elements can act as a mechanism to mix the three colours, and to display the mixed light as a uniform luminous object in brightness and mixed colour. It would be understood that more colours of light-emitting elements could be mixed if desired, for example the inclusion of amber light-emitting elements. The linear array of light-emitting elements may be arranged in repeating groups of blue, green and red light-emitting elements. In such a configuration, the order of the light-emitting elements within each group may be determined by the luminous distribution characteristics of the light-emitting elements so as to maximize the uniformity of luminance of the luminaire.

Figure 7:
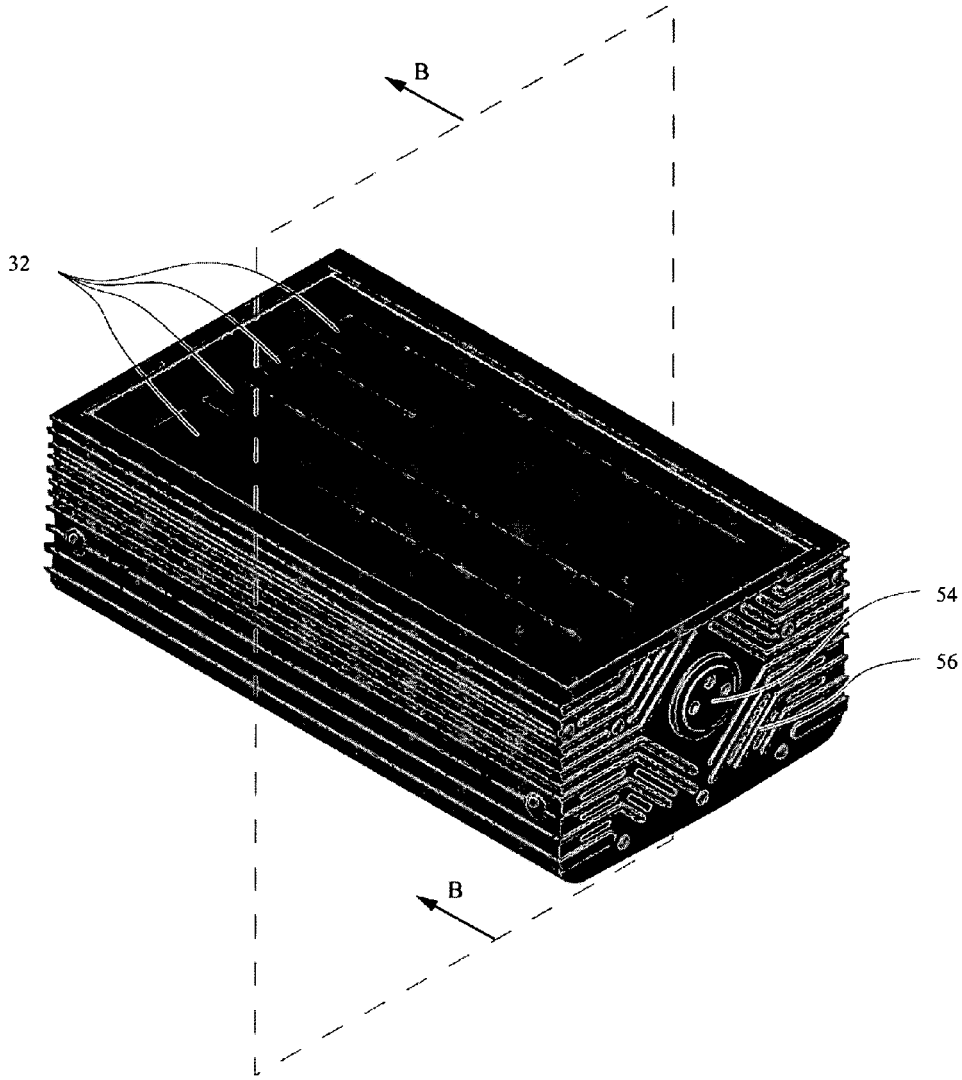
FIG. 7 shows an isometric view of a luminaire with integrated light-emitting elements arranged in a matrix layout, according to one embodiment of the present invention.
Figure 9:
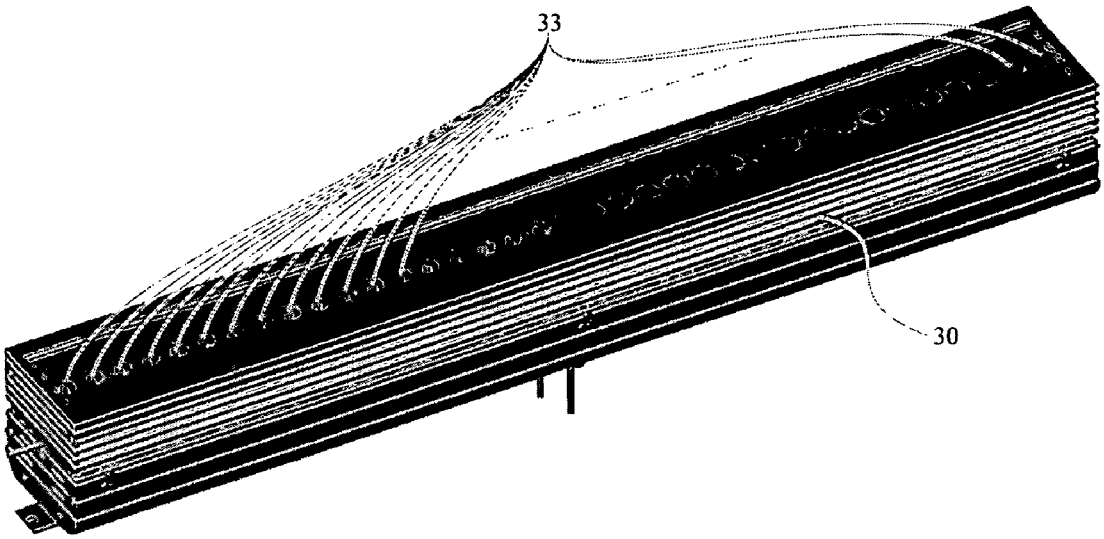
FIG. 9 illustrates an isometric view of a luminaire with integrated light-emitting elements arranged in a linear layout according to one embodiment of the present invention.

In one embodiment of the invention illustrated in FIG. 7, the light-emitting element array is laid out in a 2-dimensional matrix fashion on the heat sinking base 54 that allows the base cover 56 of the luminaire 10 to be short and wide. In this configuration, the PSU 40 and controller 42 (not shown) can be placed side by side in the lower compartment 24 of the housing 20 as illustrated in FIG. 8, for example. In a further exemplary embodiment shown in FIG. 9, the light-emitting elements are arranged in a linear fashion along the base 30, which allows for a longer thinner luminaire 10. In this scenario, the PSU 40 and controller 42 (not shown) can be placed end to end in a single line along the length of the luminaire 10.

Referring back to FIG. 6 in conjunction with FIG. 2, the luminaire 10 further includes an optical device 28 such as an optical diffuser that fits over the upper compartment 22 for collecting and reflecting light produced by the light-emitting elements 33. The optical device 28 includes a first and a second linear hemispherical optical diffuser 28*a* and 28*b*, respectively, to diffuse the emitted luminous flux by the light-emitting elements. A diffuser is a device which scatters incident electromagnetic radiation, including visible light, infrared and ultraviolet radiation by means of diffuse transmission or reflection into a variety of luminance distribution patterns. The optical device of the present invention is not limited to diffusers, and the optical device 28 used for the manipulation of light from the light-emitting elements may be in a variety of configurations and a combination of optical devices 28 may be used together to provide a desired luminous flux distribution. Optical device 28 may be used to collimate light from the light-emitting elements in a desired direction or diffuse the light in a desired direction, for example, thus providing a variety of desirable luminous flux distributions. The optical device 28 may further enhance the luminous flux characteristics of the light-emitting elements resulting in improved power efficiency, but also it can serve to further dissipate heat generated by the light-emitting elements through its structure.

An optical element 50 having a generally parabolic spectrally selective reflective surface is also disposed in the plane perpendicular to the collinear axes of said diffusers 28*a* and 28*b*. Accordingly, the light from the different coloured light-emitting elements in the array is "collected" into the first diffuser 28*a* by the optical element 50 which can be for example a collector. The optical element 50 can be designed to collimate the emitted flux from said light-emitting element array in a direction generally perpendicular to the linear axis of said optical element 50 and preferentially diffuse the flux in a direction generally parallel to the linear axis of said optical element 50, which could be either specular, diffuse or a combination of both. Another method of collecting the light is to use a lens that uses "total internal reflection" to efficiently couple the light from the plurality of light-emitting elements in the array.

Various other non-imaging optical devices may also be used to enhance the light flux of the light-emitting elements. In another embodiment of the present invention, a compound parabolic collector or similar non-imaging optical device can be used as the optical element 50, wherein the reflective surfaces of said device are specularly reflective. In another embodiment a compound parabolic collector or similar non-imaging optical device can be used as the optical element 50, wherein the reflective surfaces of said device comprise microreplicated or holographic optical elements to preferentially reflect the emitted flux of said light-emitting element array to produce a generally desirable luminous flux distribution. In yet another embodiment a compound parabolic collector or similar non-imaging optical device can be used as the optical element 50, wherein said device comprises one or a multiplicity of moulded or extruded plastic lenses.

In the presently described embodiment, the planar optical diffuser 26 is disposed coplanar to the first diffuser 28*a* which diffuses the emitted flux from light-emitting elements array outwardly towards the second diffuser 28*b*. As a result, the flux may appear to function as a secondary light source. The second diffuser 28*b* located coaxial to the first diffuser 28*a* further diffuses the flux and thereby appears to a viewer to possess approximately constant luminance along the length of the second diffuser 28*b* from all viewing directions of the luminaire 10. The planar diffuser 26 can allow further diffusion of the light enhancing the colour mixing. In an alternative embodiment of the present invention, a first hemispherical linear optical diffuser 28*a* or second hemispherical linear diffuser 28*b* may be used wherein said types of diffusers comprises frosted glass; moulded, embossed, extruded, or formed plastic; or a holographic diffuser. Similarly, in one embodiment of the present invention, a first or second hemispherical linear optical diffuser 28*a*, 28*b* may be used whereby the diffuser 28*a* or 28*b* comprises a linear or elliptical holographic diffuser to diffuse the emitted flux of said light-emitting elements array in a preferred direction to produce a generally desirable luminous flux distribution. In another embodiment of the present invention, a first or second hemispherical linear optical diffuser 28*a*, 28*b* may be used wherein the diffuser comprises a circular holographic diffuser to improve the transmittance in comparison to frosted glass or bulk plastic diffusers. A first or second hemispherical linear optical diffuser 28*a*, 28*b* having a linear pattern of grooves is embossed or moulded in one or both surfaces of the diffuser 28*a*, 28*b* may also be used. The first and second linear optical diffuser 28*a*, 28*b* may be co-extruded as a single component.

Figure 11:
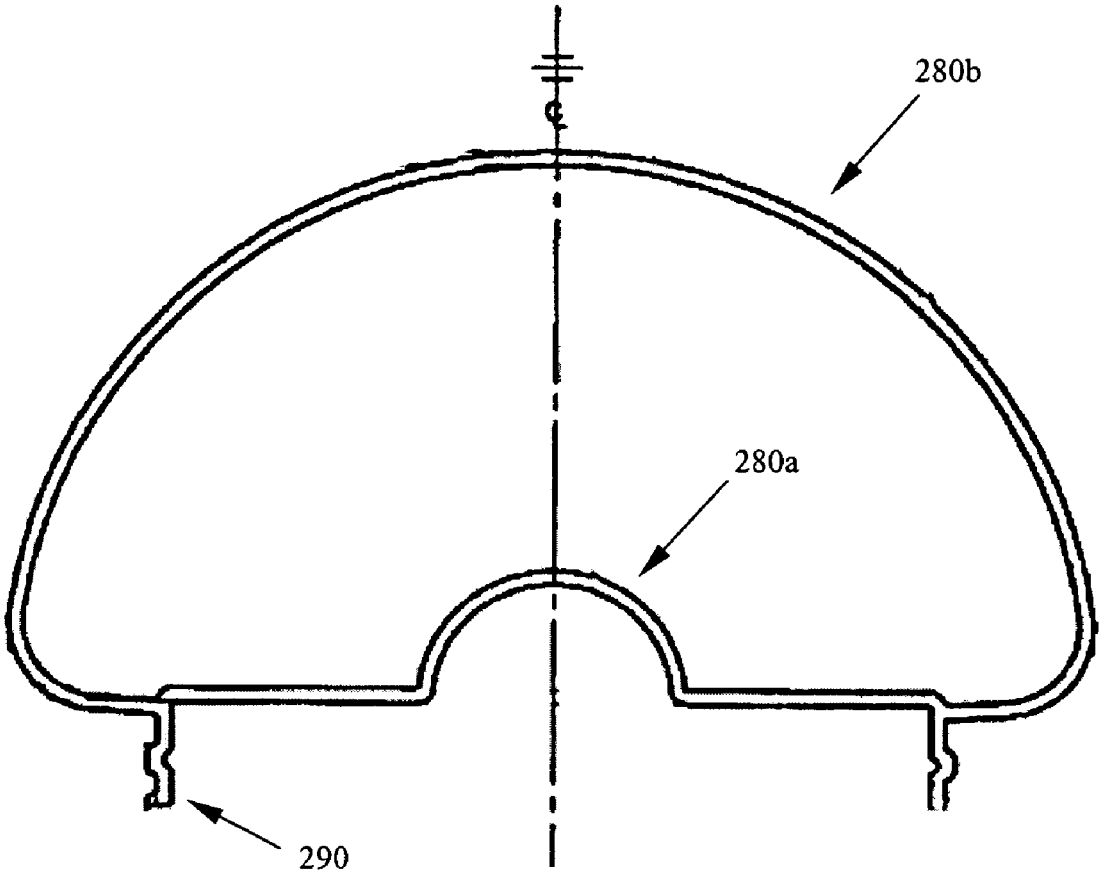
FIG. 11 is a cross sectional view of an optical device according to one embodiment of the present invention.
Figure 12:
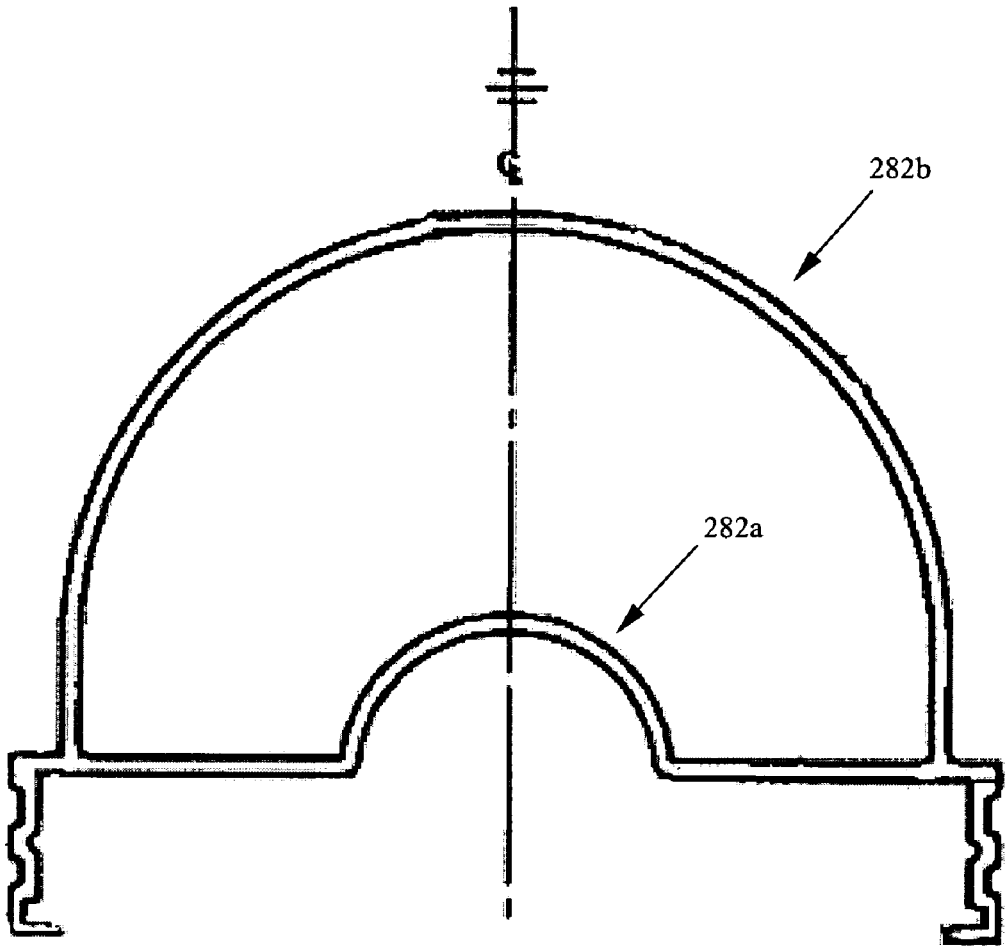
FIG. 12 is a cross sectional view of an optical device according to another embodiment of the present invention.

FIGS. 11 and 12 illustrate example configurations of the optical device comprising first and second diffusers, wherein the optical device can be mate with the upwardly projecting elements 35 and 36 of the base 30 thereby securing the optical device to the base. For example in FIG. 11, the second diffuser 280*b* has a mushroom cap configuration which can enhance the diffusion of luminous flux from the first diffuser 280*a*. Arm 290 and a corresponding one on the opposite side of this optical device can be used to couple this optical element to the base. FIG. 12 illustrates an example of the optical device wherein the first and second diffusers 282*a* and 282*b*, respectively have a semicircular cross sectional shape.

Figure 13:
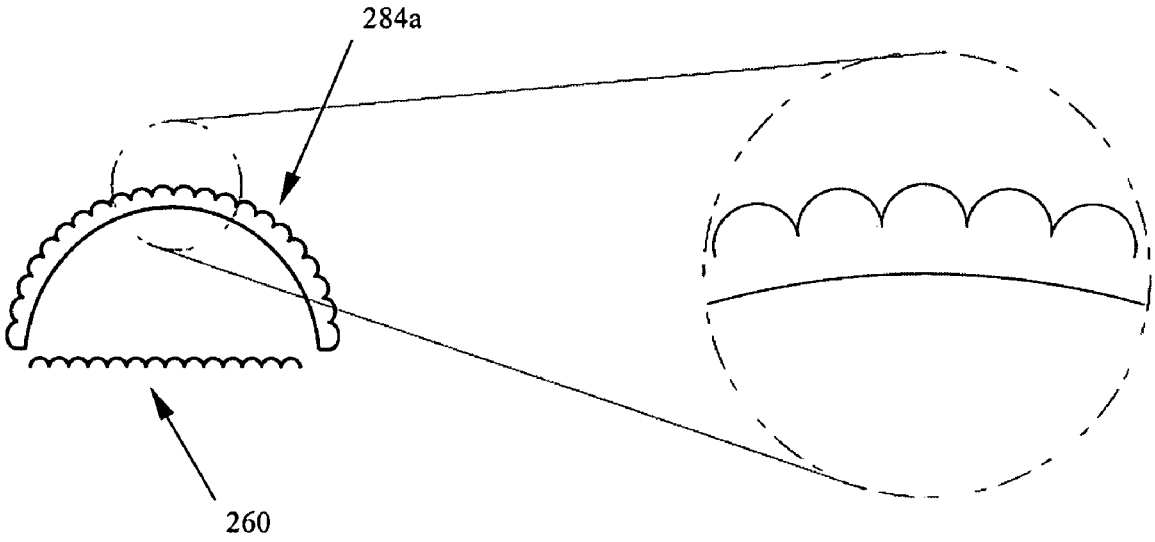
FIG. 13 illustrates is a magnified cross-sectional view of a variant of the first diffuser of the optical device according to one embodiment of the present invention.

As an example, a purpose of the first hemispherical diffuser 28*a* is to mix (or homogenize) the accepted light and secondly, mimic a luminous source, just like a fluorescent tube to provide a uniform distribution of light for the second hemispherical diffuser 28*b*. This first diffuser 28*a* can be made from a translucent plastic material, frosted glass or holographic film. Another option is to introduce spherical elements 284*a* onto the first diffuser as illustrated in FIG. 13, to further diffuse the light. The spherical elements on the first diffuser can increase the beam angle of the light, thereby providing a means for better mixing of the light from the multiple light-emitting elements. In some cases, the spherical elements on the first diffuse may provide a means for mixing the light from the multiple light-emitting elements to a uniform level prior to interaction with the second diffuser. In one embodiment in order to further diffuse the illumination, the cover plate 260 associated with the upper compartment can also comprise spherical elements. Similarly, the second hemispherical diffuser provides a means to firstly further mix (or homogenize) the accepted light emanating from the first diffuser 28*a*, and secondly, transmit the uniformly mixed light to the viewer, both uniform in brightness and colour mixing. The second diffuser 28*b* can be constructed from a translucent plastic material, frosted glass or holographic film.

The net effect of using the collector 50 and diffusing elements 28*a* and 28*b* is to provide uniform colour mixing of the light-emitting elements array in the array 33 over a relatively short distance, for example the height of the luminaire, compared to the spacing d, of the light-emitting elements array in the array 33 as shown in 5. Accordingly, a linear array of light-emitting elements may be used wherein two adjacent groups of red-emitting, green-emitting, and blue-emitting light-emitting elements are disposed such that the joint formed by two adjacent first and second linear hemispherical optical diffusers 28*a* and 28*b* is located proximate to a blue-emitting light-emitting element and an adjacent green-emitting light-emitting element. In this layout of light-emitting elements, improved colour mixing of the illumination can be achieved.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A luminaire comprising:

(a) a housing defining a first internal compartment containing one or more light-emitting elements mounted on a planar support connected to the housing, the housing further defining a second internal compartment containing electronic driver means coupled to the one or more light-emitting elements for providing controlled electrical energy to the one or more light-emitting elements, the first and second internal compartments being thermally isolated from one another; and (b) an optical means coupled to the housing for manipulating light emitted by the one or more light-emitting elements, said optical means comprising first and second diffuser elements positioned coaxially in a spaced apart configuration, said first and second diffuser elements being curved diffuser elements and said second diffuser element configured to diffuse the light subsequent to the first diffuser element.

2. The luminaire as set forth in claim 1, wherein the first and second diffuser elements are linear hemispherical optical diffusers.

3. The luminaire as set forth in claim 2, wherein one or more reflectors having a generally parabolic spectrally selective reflective surface is disposed in a plane perpendicular to collinear axes of the first and second diffuser elements, one of the one or more reflectors being positioned around each of the one or more light-emitting elements for collecting and reflecting light produced by the one or more light-emitting elements toward the first and second diffuser elements.

4. An optical device for use with a luminaire including two or more light-emitting elements, the optical device comprising:

(a) a first diffuser element configured to be positioned proximate to the two or more light-emitting elements, said first diffuser element being a curved diffuser element and said first diffuser element for diffusing emitted flux from the light-emitting elements; and (b) a second diffuser element having a length and positioned in coaxial spaced apart alignment with the first diffuser element, said second diffuser element being a curved diffuser element and said second diffuser ele ment for providing secondary diffusion of the emitted flux;

thereby enabling creation of a substantially constant luminance along the length of the second diffuser.

5. The optical device as set forth in claim 4, wherein the first and second diffuser elements are hemispherical diffusers.

6. The optical device as set forth in claim 4, wherein the first diffuser element comprises a plurality of spherical elements.

7. The optical device as set forth in claim 4 wherein the second diffuser element has a mushroom cap cross sectional shape.

8. The optical device as set forth in claim 4, wherein the first and second diffuser elements are selected from the group comprising a linear holographic diffuser, an elliptical holographic diffuser, a frosted glass and a circular holographic diffuser.

9. The optical element as set forth in claim 4 wherein the first and second diffuser elements are configured as an integral extruded element.

10. The optical element as set forth in claim 9 wherein the integral extruded element is plastic.

* * * * *